United States Patent [19]

Laverick et al.

[11] Patent Number: 4,541,338

[45] Date of Patent: Sep. 17, 1985

[54] SHEET NUMBERING MACHINE

[75] Inventors: William J. Laverick, Chula Vista; George A. Kendall, Solana Beach, both of Calif.

[73] Assignee: Wizer, Equipment, Inc., National City, Calif.

[21] Appl. No.: 541,999

[22] Filed: Oct. 14, 1983

[51] Int. Cl.[4] ..... B41F 1/06

[52] U.S. Cl. ..... 101/316; 101/407 BP; 400/434.2

[58] Field of Search ..... 101/78, 79, 407 BP, 101/316, 318, 320, 317, 82, 93.37, 93.43, 69, 80, 292, 293, 294, 295, 319, 321, 126; 248/188.2, 188.4; 400/427, 434.2

[56] References Cited

U.S. PATENT DOCUMENTS

| | | | |
|---|---|---|---|
| 174,017 | 2/1876 | Sigwalt | 101/407 BP |
| 177,699 | 5/1876 | Dockum | 101/407 BP |
| 357,668 | 2/1887 | Hamilton | 400/434.2 X |
| 676,083 | 6/1901 | Bates | 101/79 |
| 1,058,688 | 4/1913 | Myers | 400/434.2 X |
| 2,025,691 | 12/1935 | Mintz | 101/407 BP |
| 3,071,887 | 1/1963 | Von Arb | 248/188.4 |

FOREIGN PATENT DOCUMENTS

| | | | |
|---|---|---|---|
| 1413847 | 11/1975 | United Kingdom | 101/78 |
| 738915 | 6/1980 | U.S.S.R. | 101/292 |

*Primary Examiner*—Edgar S. Burr
*Assistant Examiner*—Charles A. Pearson
*Attorney, Agent, or Firm*—Baker, Maxham, Callan & Jester

[57] ABSTRACT

A machine for imprinting numbers on sheets of paper, particularly in a consecutive order, includes a base in the form of a box-like housing in which is located a levelling mechanism for levelling a platen against which sheets of paper are supported for imprinting a number by means of an imprinting head supported for reciprocal movement toward and away from the platen by means of an arm extending upward from the base member and including a solenoid for reciprocal movement of the print head toward and away from the platen. The level of the platen for precisely adjusting the support surface of the platen for uniformly printing the numbers includes a pair of adjustable screw mechanisms disposed on orthogonal axes for selectively adjusting the slope of the platen. An alternative embodiment includes a solenoid operated plunger acting against a fixed platen disposed in the center of a sheet support table.

4 Claims, 10 Drawing Figures

SHEET NUMBERING MACHINE

BACKGROUND OF THE INVENTION

The present invention relates to paper printing machines and pertains particularly to numbering machines for printed matter.

It is frequently necessary or desirable to number sheets of paper and the like, such as printed matter, which are incorporated in books, booklets, fliers, and the like. Such numbering or lettering when not done in the printing process, is frequently done by hand. Such numbering can become an exhausting and time consuming exercise. In addition, hand numbering frequently does not achieve uniform print quality and/or location and orientation of the numbering or lettering applied to the sheets.

It is therefore desirable that an improved numbering machine be available which is adjustable to provide uniform and accurately positioned numbering on sequences of sheets of paper and the like.

SUMMARY AND OBJECTS OF THE INVENTION

It is the primary object of the present invention to provide an improved numbering machine.

In accordance with the primary aspect of the present invention, a machine for applying numbers, letters, and the like to sheets of paper includes a box-like base support structure in which is mounted an adjustable sloped platen for supporting sheets to be numbered with an imprinting head supported for reciprocal movement toward and away from the platen. Adjustable means are provided for adjusting the impact of the print head on the platen as well as the slope of the platen relative to the print head.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
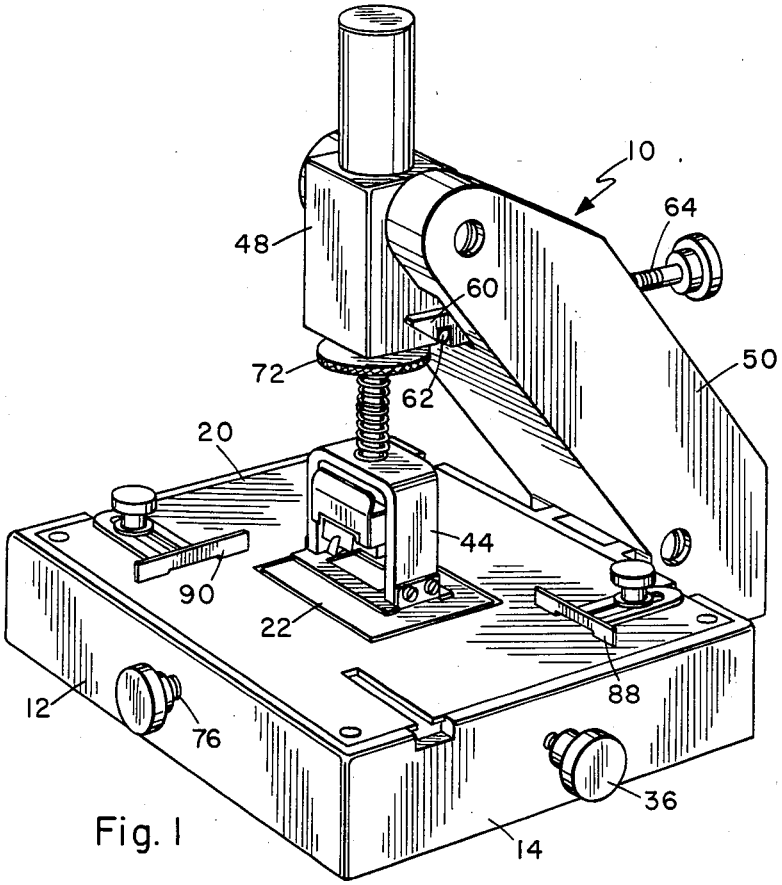
FIG. 1 is a perspective view of a preferred embodiment of the invention.
Figure 2:
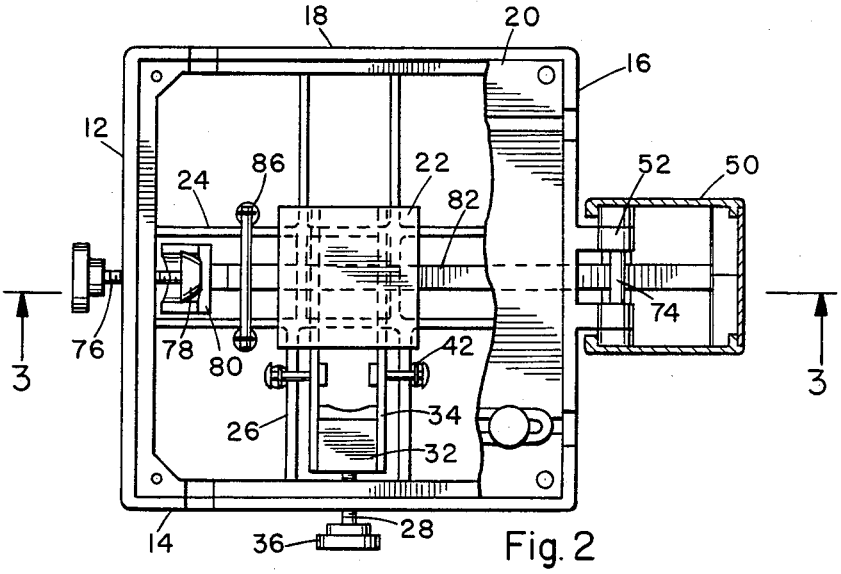
FIG. 2 is a top plan view of the embodiment of FIG. 1.

Referring to the drawings, a numbering or imprinting machine in accordance with the invention is designated generally by the numeral 10. This machine includes a generally box-like base support structure defined by four (4) peripheral, generally rectangular, walls 12, 14, 16 and 18 forming a box-like housing. The base includes an upper support surface 20 in which is mounted an adjustable central, generally flat, square, rectangular platen 22 for supporting a sheet on which numbers, letters, and the like are to be imprinted. The platen 22 is supported in a mechanism mounted within the housing including a platen slope adjusting device including crossed pairs of support rails 24 and 26. A screw and nut mechanism with screw 28 and cam follower 30 cooperating with cam 32 or lever 34 which is mounted for supporting the platen provides for adjusting the slope of the platen about a horizontal axis. The platen slope adjusting mechanism includes a hand knob 36 that extends externally of the housing which is mounted on the outer end of the screw and is rotatable by hand for adjusting the slope of the platen about the particular axis perpendicular to pivot axis 74 of support arm 50. The platen support lever 34 is pivotally mounted by an arcuate fulcrum block 38 on a cooperating fulcrum support 40 on the support rails.

The platen 22 is a generally square, flat, table support surface on which the paper is supported for engagement by the imprinting head. The platen 22 is positioned in the center of a table support surface 20 which is of a generally square, or rectangular, configuration to fit within, or cover the upper or top of, the base forming the housing. A spring 42 biases the lever 34 into engagement with the fulcrum support 40 and the cam follower 30 on screw 28.

An imprint head 44 is positioned and supported above the platen on an adjustable reciprocating plunger 46 which is mounted within a mounting support block 48 mounted on the upper end of an angled arm 50 or housing which is pivotally attached by a pivot bracket 52 to the side and extends upward from the base support structure. The arm 50 defines a generally box-like elongated housing (FIG. 3) in which is mounted an actuating solenoid 54 and a cable structure including a cable 56 supported on a pulley 58 and operatively connected through a spring 57 to the reciprocating plunger 46. Upon actuation of the solenoid 54, the cable 56 is pulled and forces the plunger 46 downward forcing the printing head 44 downward against the platen 22, printing or imprinting a number, letter, or the like, on a sheet of paper resting thereon.

Figure 5:
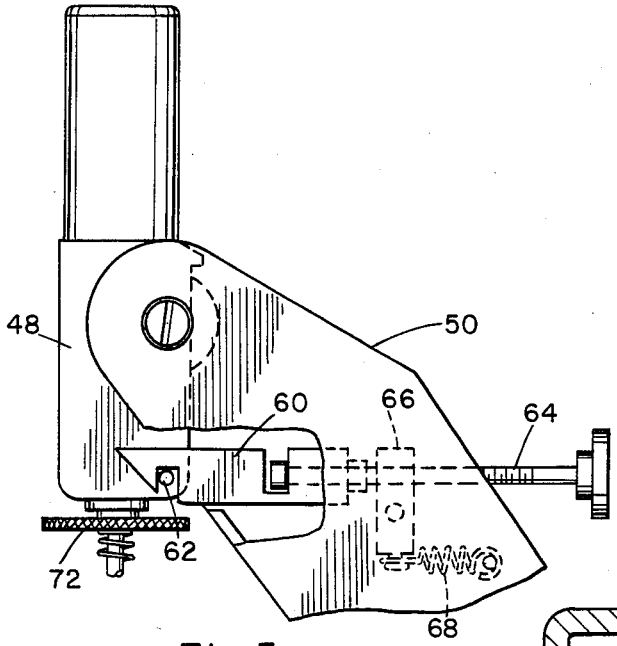
FIG. 5 is an enlarged partial view of the plunger head with portions broken away to show details.
Figure 6:
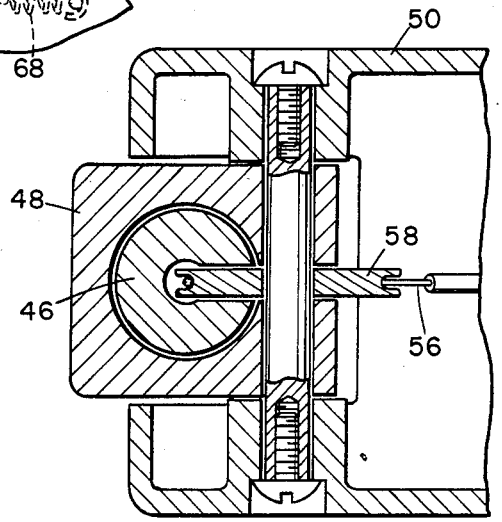
FIG. 6 is a section view taken on line 6—6 of FIG. 3.
Figure 7:
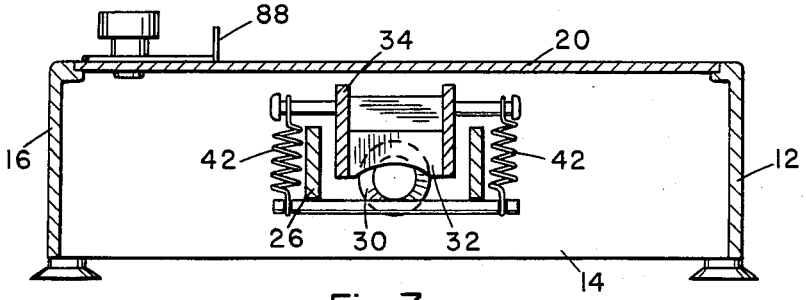
FIG. 7 is a section view taken on line 7—7 of FIG. 4.

The housing arm 50 includes, or is defined by generally opposing box-like structures forming an enclosed elongated housing. A latch mechanism (FIG. 5) includes a latch arm 60 that engages a latch pin 62 on block 48 and a thumb screw 64 for securing the arm in position. The latch arm 60 engages the latch pin 62 on the support block 48 for the reciprocating plunger which is pivotally mounted in the support arm 50 for pivotal movement about a horizontal axis to pivot and swing outward to permit access to the print head 44 for adjustment, cleaning, and the like. The thumb screw 64 is mounted in a thread bore of a block 66 pivotally mounted on one side of arm housing 50. A spring 68 retains the latch in engagement. The screw 64 moves the latch axially thereof on rotation to adjust the vertical axis of the plunger and the slope of head 44 on platen 22.

A remote actuating switch (not shown) to be foot-operated, and the like, is connected by suitable electrical conductors to the solenoid control and actuates the solenoid 54 for reciprocating the print head 44 into printing engagement with the platen 22 and paper, and the like, supported thereon.

The print head 44 is of the type, for example, utilized for consecutive printing of sheets of pages and the like. Such print heads have the capability of selectively printing consecutively or multiple numbers or the like, as selected.

Figure 3:
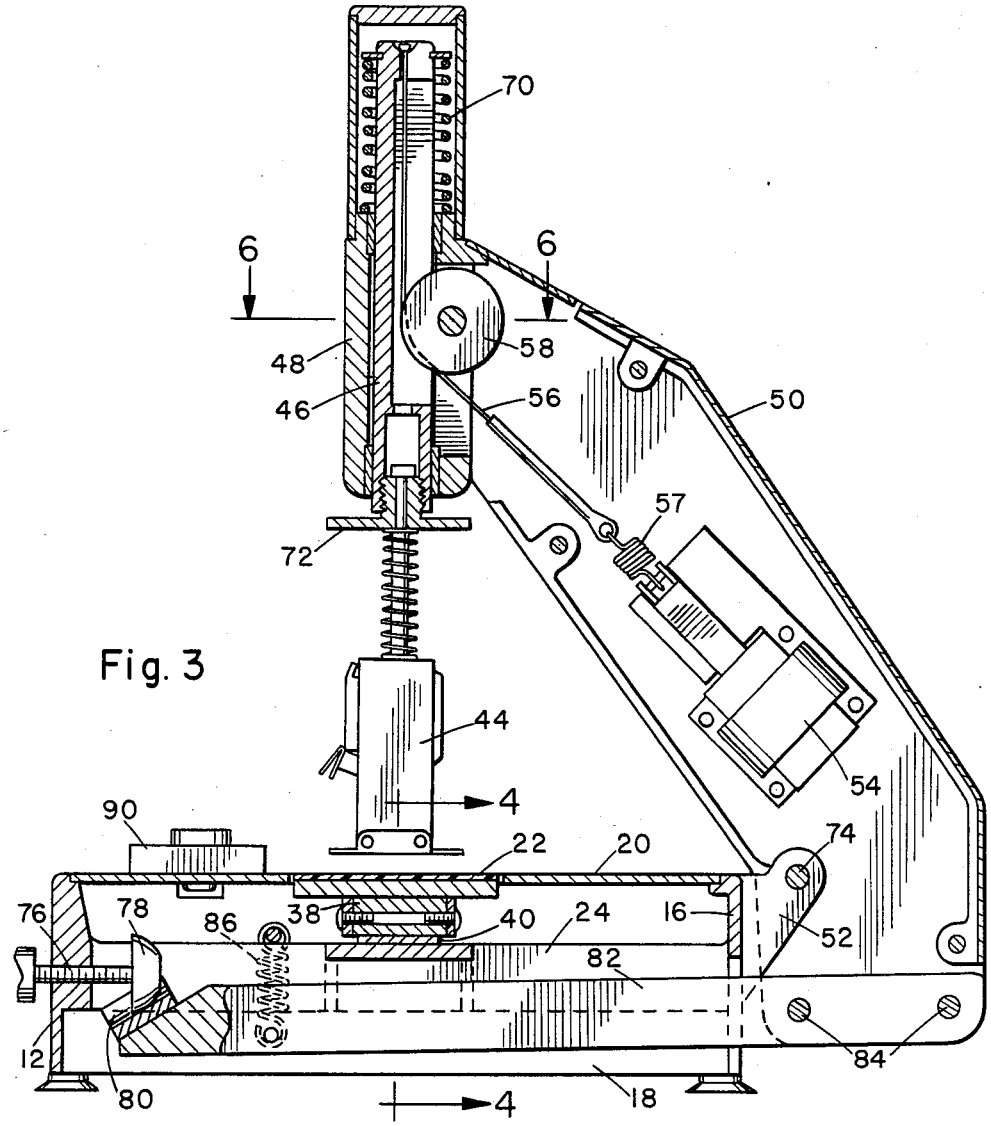
FIG. 3 is a section view taken generally on line 3—3 of FIG. 2.
Figure 4:
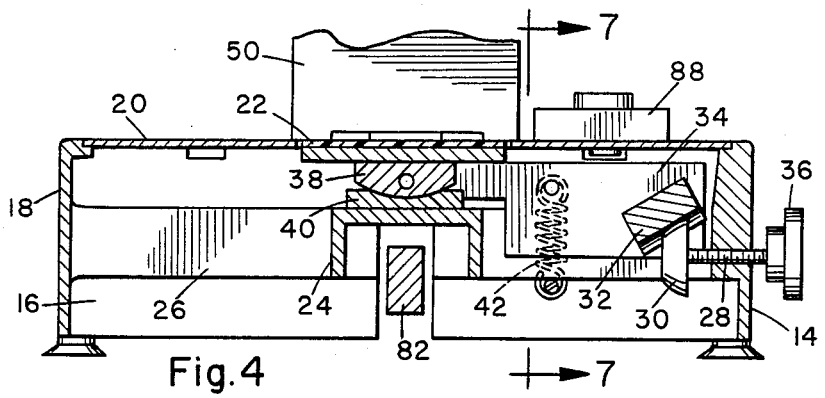
FIG. 4 is a section view taken generally on line 4—4 of FIG. 3.

The plunger 46 is biased or returned to its uppermost or retracted position by a compression spring. The print head 44 is mounted by a hand screw 72 in a threaded bore in the plunger 46 (FIG. 3). Vertical adjustment of the print head 44 toward or away from platen 22 is accomplished by tilting of the support arm 50 about pivot pin 74 in bracket 52. The pivoting of arm 50 is carried out by a screw 76 having a cam follower 78 engaging a cam 80 on a lever arm 82 that is secured to the lower end thereof, such as by bolts 84. A spring 86 biases lever 82 and arm 50 to the upper position.

Suitable stop or guide means 88 and 90 are mounted on the support table and are adjustable for engagement by sheets of paper and the like for positioning the paper relative to the print head 44. The print head 44 is adjustable about the vertical axis to orient 360° for orienting relative to a sheet of paper for proper positioning and orientation of the numbering, lettering, or the like. Similarly, pressure adjusting means, as above described, in the form of a hand screw 76, is available for adjusting the pressure exerted on the platen by the print head 44 during the stroke thereof for printing single or multiple copies, such as carbons, pressure-sensitive, or the like.

Figure 8:
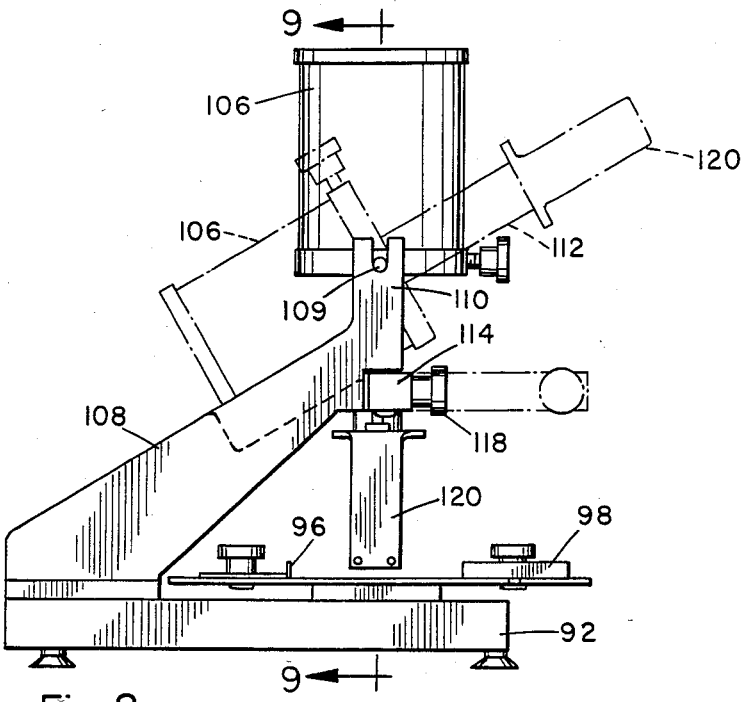
FIG. 8 is a side elevation view of an alternate embodiment.
Figure 9:
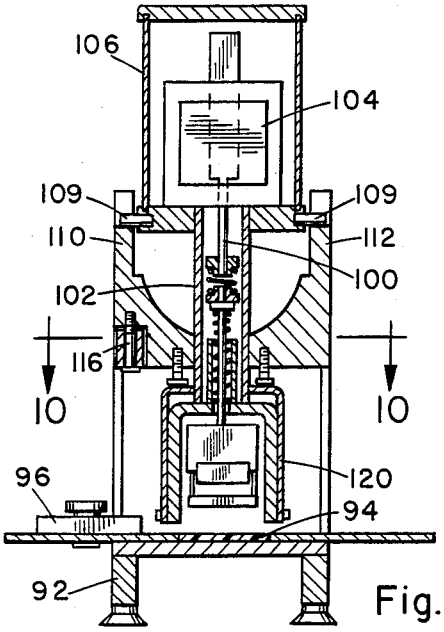
FIG. 9 is a view taken on line 9—9 of FIG. 8.
Figure 10:
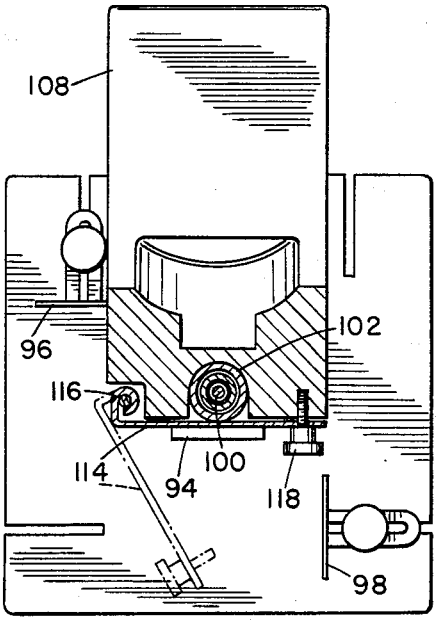
FIG. 10 is a view taken on line 10—10 of FIG. 9.

Referring now to FIG. 8, an alternate embodiment is illustrated wherein a base structure 92 includes a centrally located platen 94. Guide means 96 and 98 for guiding and positioning sheets on the support table are provided at each side thereon. A plunger 100 is mounted for reciprocal movement in a vertical tubular support structure 102 wherein a solenoid 104 is mounted in a housing on the upper end of an arm 108. The housing 106 is pivotally mounted by pins 109, in brackets 110 and 112 on arm 108. A releasable arm 114 pivotally mounted at 116, and by releasable screw 118, to hold plunger housing 102 in the vertical position. A print head 120 is mounted on the lower end of the plunger for movement into engagement with the platen 94. A remote control mechanism (not shown) including a foot operated switch is connected by suitable electrical conductors for control of the solenoid for activating the solenoid for the printing stroke.

While we have illustrated and described our invention by means of specific embodiments, it is to be understood that numerous changes and modifications may be made therein without departing from the spirit and scope of the invention as defined in the appended claims.

We claim:

1. A character imprinting machine comprising:

a base, a platen mounted on said base for supporting a sheet of paper to be imprinted, a support arm secured to said base at one side of said platen and extending to a position above said platen, a reciprocating plunger pivotally mounted on and supported by said arm above said platen and reciprocable toward and away from said platen, a printing head mounted on said plunger for engaging and imprinting a character on a sheet supported by said platen, first and second means for respectively adjusting the relative slope of said platen and said printing head to one another about orthogonal axes, said second means for adjusting is defined by releasable latch means for reliably holding said plunger in a vertical position oriented toward said platen and comprises screw and nut means mounted on said arm for selectively adjusting the vertical orientation of said plunger relative to said platen, and solenoid power means located remote from said plunger and comprising cable and pulley means including resilient link means connecting said solenoid to said plunger.

2. The character printer of claim 1 wherein said platen is supported on a pivotally mounted lever, and cam and screw means mounted in said base adjustably engage said lever for adjusting said platen.

3. A character imprinting machine comprising:

a base, a platen mounted on a pivotally mounted lever on said base for supporting a sheet of paper to be imprinted, first means including said lever for adjusting the slope of said platen means by a screw and cam mechanism, a support arm pivotally secured to said base at one side of said platen and extending to a position above said platen, a reciprocating plunger mounted on and supported by said arm above said platen and reciprocable toward and away from said platen, a printing head mounted on said plunger for engaging and imprinting a character on a sheet supported by said platen, said first and second means for respectively separately adjusting the relative slope of said platen and said printing head to one another about orthogonal axes, screw activated cam and lever means for pivotally adjusting said arm relative to said base for adjusting said printing head toward and away from said platen, and solenoid power means located remote from said plunger and comprising cable and pulley means including resilient link means connecting said solenoid to said plunger.

4. A character printing machine comprising:

a generally box-like base, a generally rectangular support table mounted on said base, a platen disposed proximate the center of said table and pivotally mounted for movement about a single axis for selectively adjusting the slope thereof, an elongated lever connected to said platen and extending outward therefrom, cam and screw means mounted in said base and engaging said lever for selectively adjusting the slope of said platen, an elongated support arm pivotally secured to one side of said base and extending upward to a position above said platen, a reciprocating plunger pivotally mounted on said arm above said platen, solenoid means carried by said support arm for reciprocating said plunger, cable means connecting said solenoid means to said plunger, a printing head mounted on said plunger for engaging and imprinting a character on a sheet support by said platen, elongated adjusting arm means secured to said support arm and extending across said base, cam and screw means mounted in said base and engaging said adjusting lever for selectively tilting said support arm for adjusting said plunger toward and away from said platen, adjustable latch means for releaseably latching said plunger in a vertical position oriented toward said platen, and adjusting means for selectively adjusting the position of said latch means for adjusting the vertical orientation of said plunger relative to said platen.

* * * * *